United States Patent [19]

Takahashi

[11] 4,167,231

[45] Sep. 11, 1979

[54] NEEDLE CASE

[76] Inventor: Masamitsu Takahashi, 3-3, 2-chome, Kusunoki-cho, Hiroshima-shi, Hiroshima-ken, Japan

[21] Appl. No.: 905,189

[22] Filed: May 12, 1978

[30] Foreign Application Priority Data

| | | | |
|---|---|---|---|
| Sep. 1, 1977 | [JP] | Japan | 52-117619[U] |
| Nov. 10, 1977 | [JP] | Japan | 52-150805[U] |
| Nov. 10, 1977 | [JP] | Japan | 52-150806[U] |

[51] Int. Cl.[2] ..... B65D 85/24

[52] U.S. Cl. ..... 206/382; 206/383

[58] Field of Search ..... 206/382, 380, 383, 309, 206/313; 312/13

[56] References Cited

U.S. PATENT DOCUMENTS

| | | | |
|---|---|---|---|
| 3,102,635 | 9/1963 | Werwin et al. | 312/13 |
| 3,227,265 | 1/1966 | Schneider | 206/382 |
| 3,245,524 | 4/1966 | Audia | 206/382 |
| 3,951,263 | 4/1976 | Vale | 206/382 |

*Primary Examiner*—William T. Dixson, Jr.

*Attorney, Agent, or Firm*—George B. Oujevolk

[57] ABSTRACT

A needle case comprises a substantially rectangular shaped needle holder piece including an opening therein and a needle holder portion provided between the opening and one side of the holder piece, a plurality of needles being suitably supported through the needle holder portion, and a transparent cover fitted over the needle holder piece, whereby when the needle holder piece is moved relative to the cover by a desirable distance in the direction of removing the needle holder piece, the needles will then be easy to remove and replace.

2 Claims, 14 Drawing Figures

NEEDLE CASE

BACKGROUND OF THE INVENTION

The present invention relates to a needle case and more particularly, to a needle case from which it is easy to draw a desired needle.

Conventional needle packages comprise a sheet cover having a holder portion, and a small card in which a plurality of needles are kept, suitably wrapped by the sheet cover removably fitted over the holder portion of the sheet cover.

In use, after the sheet cover is opened, the small card is drawn from the holder portion of the sheet cover to remove a desired one of needles from the card.

However, with the above conventional needle packages, they tend to get bent or out of shape because of the fact that both the sheet cover and the card are of paper after a good deal of use by placing the card in the sheet cover and taking out the card from the sheet cover. Accordingly, high durability can not be preserved. Moreover, the conventional needle packages are not easy to handle because of troublesome steps comprising opening the wrapping of the sheet cover, drawing the card from the holder portion of the sheet, and removing the desired needle from the card. Furthermore, another drawback is that the sheet cover is usually provided with an opening for observing the needles supported by the card from the outside. However, it is impossible to observe the back of the needles which do not face to the window. Thus, users are apt to overlook rust, crack and discoloration occurred in the needles.

SUMMARY OF THE INVENTION

With the above in mind, an object of the present invention is to provide a needle case which has high durability in use.

Another object of the present invention is to provide a needle case which is quite easy to handle.

Another object of the present invention is to provide a needle case wherein the fabricating cost is reduced.

Another object of the present invention is to provide a needle case wherein it is easy to observe the condition of needles from the outside.

In an embodiment of the present invention, there is provided a needle case comprising a substantially rectangular shaped needle holder piece essentially consisting of an opening therein, a recess formed on a longitudinal side thereof, and a needle holder portion provided between the opening and the recess, a plurality of needles being suitably supported through the needle holder portion, the recess having such a depth that each head of the needles is located within the recess when the needles are respectively accommodate in the needle case, and a transparent cover fitted over the needle holder piece, whereby, when the needle holder piece is drawn relative to the cover by a desirable distance in the direction of removing the needle holder piece, a desired one of needles will then be easy to remove and replace.

In a modification of the embodiment of the present invention, the cover formed to be U-shaped in cross section is pivoted on one corner of the needle holder piece, whereby, when the needle holder piece is revolved relative to the cover by a desirable angle in the direction of removing the needle holder piece, a desired one of needles will then be easy to remove and replace.

In another embodiment of the present invention, there is provided a needle case comprising a substantially rectangular shaped needle holder piece which comprises a first division having a first opening therein and a second division having a second opening therein, hingedly connected to the first division, which second division has a needle holder portion through which a plurality of needles are suitably supported, and a transparent cover fitted over the holder piece, whereby when the needle holder piece is drawn upwards relative to the cover to the upper end of the second division in the direction of removing the needle holder piece and then the first division is inclined backwards, a desired needle then will be easy to remove and replace.

The feature and advantages of a needle case according to the present invention will become more apparent from the following description taken in conjunction with the accompanying drawings, in which.

In these drawings, the same reference numerals indicate the same or similar elements of the needle case of the present invention.

DETAILED DESCRIPTION OF THE PREFERRED EMBODIMENTS OF THE INVENTION

Figure 1:
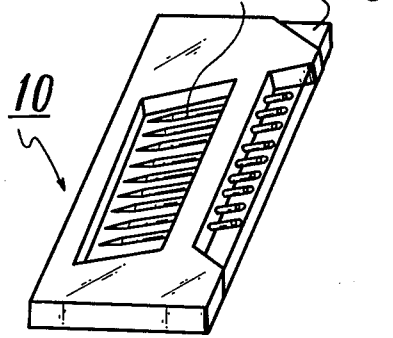
FIG. 1 is a perspective view which schematically illustrates a preferred embodiment of a needle case according to the present invention.

FIG. 1 shows a needle case, designated by reference numeral 10, employed in an embodiment of the present invention wherein a cover 30 is fitted over a needle holder piece 20 in which a plurality of needles 40 are kept, which components will be referred to later in more detail.

Figure 2:
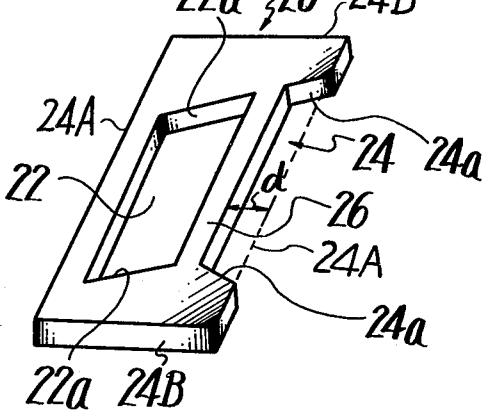
FIG. 2 is a perspective view schematically illustrating a needle holder piece shown in FIG. 1.
Figure 3:
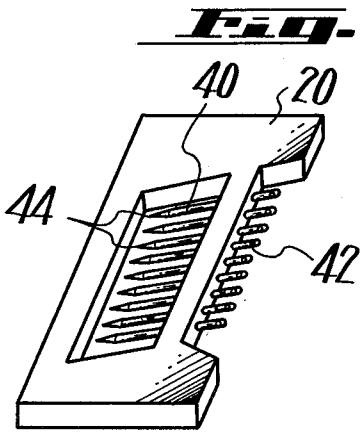
FIG. 3 is a perspective view schematically illustrating a needle holder piece in which a plurality of needles are kept, shown in FIG. 2.

Referring to FIGS. 2 to 3, the substantially rectangular shaped needle holder piece 20 comprises a rhombic shaped opening 22 formed by cutting the holder piece 20, a recess 24 formed at any one of longitudinal sides 24A thereof and a needle holder portion 26 provided between the opening 22 and the recess 24, which holder portion 26 is a joint between lateral sides 24B of the holder piece 20. A plurality of needles 40 are suitably supported through the holder portion 26. The recess 24 is provided with such a depth d that each head of needles 40 is suitably located within the recess 24 when the needles are respectively accommodated in the needle case 10. The recess 24 is provided at the both sides thereof with oppositely inclined surfaces 24*a*. The rhombic shaped opening 22 is provided with a pair of parallel surfaces 22*a*. As best shown in FIGS. 1 and 3, needles 40 are received in the needle holder portion 26 of the needle holder piece 20 in such a manner that they are disposed in parallel with the pair of surfaces 22*a* of the opening 22 and any one of inclined surfaces 24*a* of the recess 24.

The needle holder piece 20 is preferably made of synthetic blister resin, wherein the synthetic blister resin is any one of polystyrene, polyethylene and synthetic rubber. Since the holder piece 20 is of synthetic blister resin, the needles 40 can be well supported through the holder portion 26 integral with the holder piece 20 by sticking them therethrough without provision of needles holes in the needle portion 26.

Figure 4:
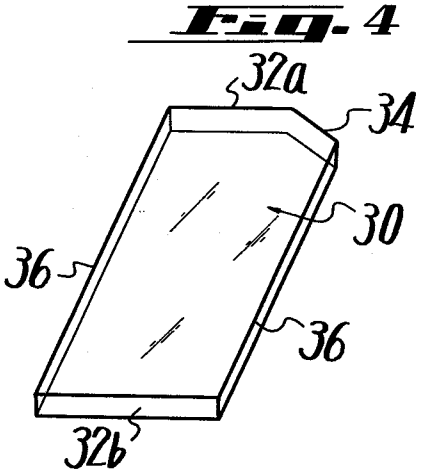
FIG. 4 is a perspective view schematically illustrating a transparent cover shown in FIG. 1.

As shown in FIG. 4, a transparent cover of a synthetic resin designated by reference numeral 30 is removably fitted over the needle holder piece 20 wherein the synthetic resin is preferably any one of polyvinyl chroride, polyamide polyester and acrylic acid resin. The transparent cover 30 may be colorless or colored. More particularly, at least one of side 32*a* and 32*b*, which is positioned in the direction of removing the holder piece 20, is open.

The cover 30 is also at any one corner thereof provided with an inclined surface 34 to make easy to draw the holder piece 20 from the cover 30. In other words, each needle's eye 42 (corresponding to the head of the needle) is disposed within the recess 24, while each needle point 44 is disposed within the opening 22. In use, you hold the intermediate longitudinal sides 36 of the cover 30 between finger and thumb and with the other hand grasp a holder portion 28 corresponding to the corner which is adjacent to the inclined surface 34, and draw the needle holder piece 20 relative to the cover 30 by a desirable distance in the direction of removing the needle holder piece 20.

At this stage, a thread (not shown) may be run through the needle's eye 42 of a desired one of needles 40 kept in the needle holder portion 26.

A desired one of needles 40 will then be easy to remove from the needle holder portion 26 of the needle holder piece 20.

As will be obvious from the foregoing description in regard to the embodiment according to the present invention, the following advantages will accrue.

a. Since the needle holder piece 20 is made of the synthetic blister resin, it has good strength as compared with a conventional holder made of paper. Therefore, the needle holder piece 20 is completely free from getting out of shape to ensure a high durability in use. Further, to support or hold the needles 40, it is enough to stick them through the holder portion 26. Accordingly, it is not necessarily required to form the needle holes in the holder portion 26. This means that needles with various kinds of diameters thereof can be suitably supported.

b. Since the cover 30 is made of transparent materials, such as synthetic resin, it is easy to observe the condition of the needles kept in the needle case from outside. This ensures the maintenance of needles. In other words, the undesirable change, such as rust, crack or discoloration which may occur in or on the needles can be easily observed from either side of the needle case 10 without drawing the needle holder piece 20 from the cover 30. Accordingly, consumers or users can easily obtain a high performance of the needles.

c. To remove a desired one of the needles from the needle holder portion, it is enough to draw the needle holder piece by a desirable distance in the direction of removing the needle holder piece. Moreover, the needle holder piece serves as a needle-cushion. These facts will guarantee easiness in handling. Accordingly the efficiency will be improved.

d. Since it is unnecessary to use the sheet cover having a complicated patern, a reduction in fabricating cost will be expected.

FIGS. 5 to 8 illustrate a modification of the embodiment of the present invention.

Figure 6:
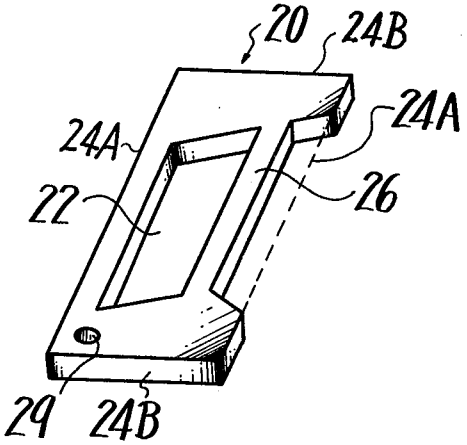
FIG. 6 is a perspective view schematically illustrating a needle holder piece shown in FIG. 5.
Figure 8:
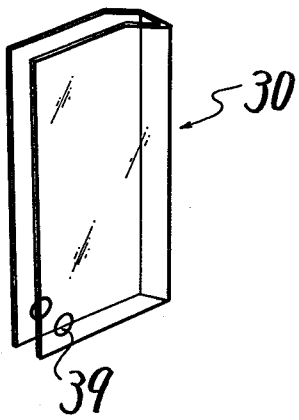
FIG. 8 is a perspective view schematically illustrating a transparent cover shown in FIG. 5.
Figure 5:
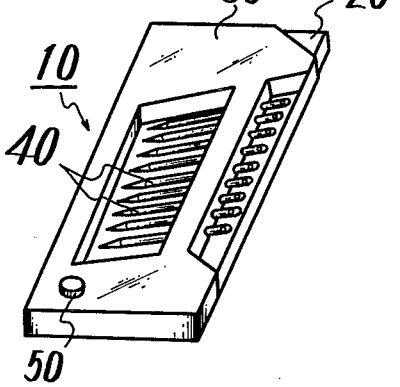
FIG. 5 is a perspective view which schematically illustrates a modification of the embodiment shown in FIG. 1.
Figure 7:
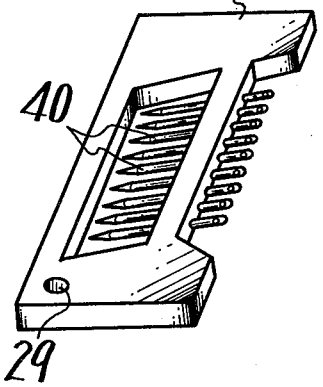
FIG. 7 is a perspective view schematically illustrating a needle holder piece in which a plurality of needles are kept, shown in FIG. 5.
Figure 11:
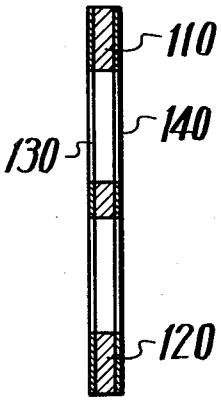
FIG. 11 is a cross sectional view taken along the line 11—11 of FIG. 10.

As shown in FIG. 5, the cover 30 is pivoted on one corner of the needle holder piece 20. The cover 30 is formed so as to be U-shaped in cross section. More particularly, the needle holder piece 20 is at one corner thereof provided with a hole 29 as shown in FIGS. 6 and 7. The cover 30 is provided at one corner thereof with a hole 39 which is in alignment with the hole 29 of the piece 20 when the cover 30 is fitted over the needle holder piece 20.

The cover 30 is pivoted on one corner of the needle holder piece 20 by means of a pin 50 inserted in the holes 29 and 39.

In use, when the cover 30 is rotated at a predetermined angle, a desired one of the needles 40 will then be easy to remove from the needle holder portion 26 of the needle holder piece 20.

Reference is now made to another embodiment of the present invention.

Referring to FIGS. 9 to 14, the needle holder piece 20 comprises a first division 110 having a rectangular shaped first opening therein 112 and a second division 120, having a rectangular shaped second opening 122 therein, hingedly connected to the first division 110. The second division 120 is provided with a needle holder portion 126 at the upper end thereof, wherein a plurality of needles 40 are suitably supported through the needle holder portion 126.

More particularly, a first sheet 130 is stuck on one side of the first and second divisions 110, 120 and a second sheet 140 is stuck on the other side of the first and second divisions 110, 120. A portion 132 of the first sheet 130, which portion is formed between the first and second divisions 110, 120 is torn transversely along the width of the needle holder piece 20 to enable the first division to be inclined backward at a desirable angle.

Figure 14:
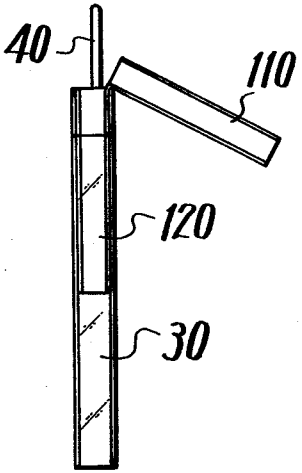
FIG. 14 is a side view of FIG. 13.
Figure 10:
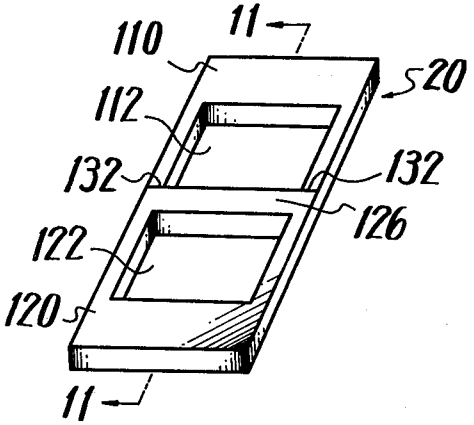
FIG. 10 is a perspective view illustrating a needle holder piece shown in FIG. 9.
Figure 13:
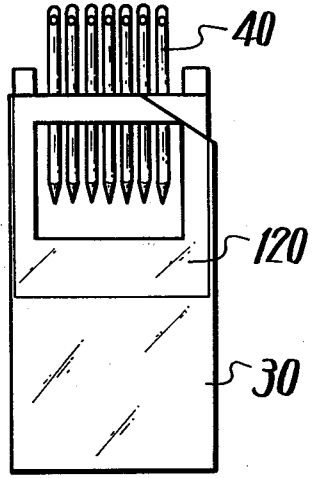
FIG. 13 is a front view illustrating the needle case shown in FIG. 9 wherein a needle holder piece is drawn upwards relative to a transparent cover to a cutting line formed between a first and a second divisions thereafter to be inclined backwards.
Figure 9:
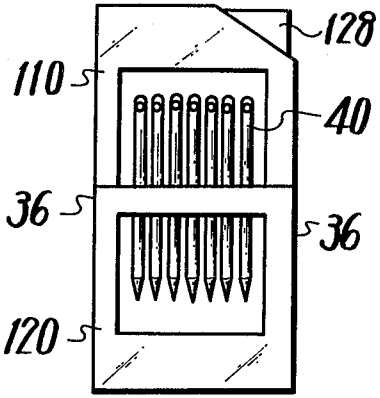
FIG. 9 is a front view which schematically illustrates a another preferred embodiment of a needle case according to the present invention.
Figure 12:
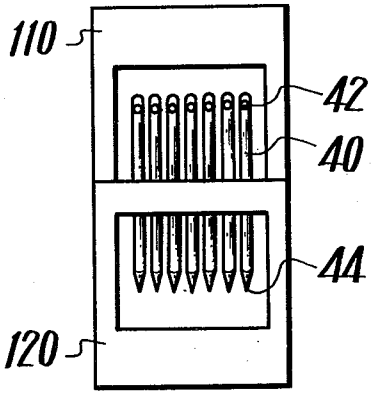
FIG. 12 is a front view illustrating a needle holder piece in which a plurality of needles are kept, shown in FIG. 9.

In use, you hold the intermediate longitudinal side 36 of the cover 30 between finger and thumb and with the other hand grasp a holder portion 128 formed at the upper end of the first division 110, and draw the holder piece 20 upwards relative to the cover 30 in the direction of removing the holder piece 20 to a cutting line corresponding to the portion 132 torn off. Then, incline the first division 110 backwards as shown in FIG. 14. Instead of drawing the holder piece 20 upwards relative to the cover 30, the needles 40 can be also easily removed by drawing downwards the cover 30 relative to the holder piece 20.

The cover shown in FIG. 4 is applicable to this embodiment.

The needles 40 will then be easily removed from the needle holder portion 126 formed at the upper portion of the second division 120.

In addition to the various kinds of advantages described in connection with the aforementioned embodiment of the present invention, more easiness to handle will be expected.

It is to be noted that modification and variations of the embodiments of the invention disclosed herein may be resorted to without departing from the spirit of the invention and the scope of the appended claims.

What is claimed is:

1. A needle case comprising:

(a) a substantially rectangular shaped needle holder piece which comprises a first division with a lower end, said first division having a first rectangular opening therein and a second division with an upper end, said second division having a second rectangular opening therein, said lower and upper ends being hingedly connected, said second division also having a needle holder portion at said upper end alongside said hinge connection, whereby a plurality of needles can be suitably supported through said needle holder portion so as to locate each needle point within said second opening; and, (b) a transparent cover fitted over said needle holder piece, whereby, when said needle holder piece is drawn upwards relative to said cover so that said cover ends at the upper end of said second division in the direction of removing said needle holder piece and then said first division is inclined backwards at a desired angle, said needles will then be easy to remove and replace.

2. A needle case as defined in claim 1 wherein a first sheet is placed on one side of said first and second divisions and a second sheet is placed on the other side of said first and second divisions, a portion of said first sheet formed between said first and second divisions being cut transversely along the width of said needle holder piece forming a hinge in said second sheet to enable said first division to be inclined backwards at a desired angle.

* * * * *